US007955451B2

(12) United States Patent
Hugus et al.

(10) Patent No.: US 7,955,451 B2
(45) Date of Patent: Jun. 7, 2011

(54) ENERGETIC THIN-FILM BASED REACTIVE FRAGMENTATION WEAPONS

(75) Inventors: George D. Hugus, Chuluota, FL (US); Edward W. Sheridan, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 697 days.

(21) Appl. No.: 11/709,233

(22) Filed: Feb. 22, 2007

(65) Prior Publication Data

US 2008/0202373 A1 Aug. 28, 2008

(51) Int. Cl.

| | |
|---|---|
| ***C06B 45/00*** | (2006.01) |
| ***C06B 45/12*** | (2006.01) |
| ***C06B 45/16*** | (2006.01) |
| ***C06B 33/00*** | (2006.01) |
| ***D03D 23/00*** | (2006.01) |
| ***D03D 43/00*** | (2006.01) |

(52) U.S. Cl. ..... 149/2; 149/14; 149/15; 149/37; 149/108.2; 149/109.2; 149/109.4; 149/109.6

(58) Field of Classification Search ..... 149/19.1, 149/109.4, 2, 14, 15, 37, 108.2, 109.2, 109.6
See application file for complete search history.

(56) References Cited

U.S. PATENT DOCUMENTS

| | | | | |
|---|---|---|---|---|
| 3,961,576 | A | 6/1976 | Montgomery, Jr. | |
| 4,996,922 | A | 3/1991 | Halcomb et al. | |
| 5,266,132 | A * | 11/1993 | Danen et al. | 149/15 |
| 5,538,795 | A | 7/1996 | Barbee, Jr. et al. | |
| 5,700,974 | A | 12/1997 | Taylor | |
| 5,717,159 | A | 2/1998 | Dixon et al. | |
| 5,912,069 | A | 6/1999 | Yializis et al. | |
| 5,936,184 | A | 8/1999 | Majerus et al. | |
| 6,276,277 | B1 | 8/2001 | Schmacker | |
| 6,494,140 | B1 | 12/2002 | Webster | |
| 6,627,013 | B2 | 9/2003 | Carter, Jr. et al. | |
| 6,679,960 | B2 | 1/2004 | Jones | |
| 6,736,942 | B2 | 5/2004 | Weihs et al. | |
| 6,843,868 | B1 | 1/2005 | Fawls et al. | |
| 6,863,992 | B2 | 3/2005 | Weihs et al. | |
| 6,955,732 | B1 * | 10/2005 | Chan et al. | 149/92 |
| 2001/0046597 | A1 | 11/2001 | Weihs et al. | |
| 2002/0069944 | A1 | 6/2002 | Weihs et al. | |
| 2003/0097953 | A1 * | 5/2003 | Serizawa et al. | 102/531 |
| 2003/0164289 | A1 | 9/2003 | Weihs et al. | |
| 2005/0142495 | A1 | 6/2005 | Van Heerden et al. | |
| 2005/0235862 | A1 | 10/2005 | Gousman et al. | |

OTHER PUBLICATIONS

U.S. Appl. No. 11/447,068, filed Jun. 6, 2006, Hugus et al.
U.S. Appl. No. 11/447,069, filed Jun. 6, 2006, Hugus et al.
U.S. Appl. No. 11/451,313, filed Jun. 13, 2006, Sheridan et al.
U.S. Appl. No. 11/504,808, filed Aug. 16, 2006, Hugus et al.

* cited by examiner

*Primary Examiner* — James E McDonough
(74) *Attorney, Agent, or Firm* — Buchanan Ingersoll & Rooney PC

(57) ABSTRACT

A munition is described including a reactive fragment having an energetic material having a least one layer of a reducing metal or metal hydride and at least one layer of a metal oxide dispersed in a binder material. A method is also described including forming a energetic material; including combining the energetic material having a least one layer of a reducing metal or metal hydride and at least one layer of a metal oxide with a polymeric binder material to form a mixture; and shaping the mixture to form a reactive fragment. The munition may be in the form of a warhead, and the reactive fragment may be contained within a casing of the warhead.

26 Claims, 2 Drawing Sheets

ENERGETIC THIN-FILM BASED REACTIVE FRAGMENTATION WEAPONS

FIELD OF THE DISCLOSURE

The present disclosure relates to energetic compositions containing a reactive thin-film for reactive fragment munitions. More specifically, the present disclosure relates to reactive fragments based, at least in part, on reactive thin-film energetic materials dispersed in a matrix.

BACKGROUND

In the discussion that follows, reference is made to certain structures and/or methods. However, the following references should not be construed as an admission that these structures and/or methods constitute prior art. Applicant expressly reserves the right to demonstrate that such structures and/or methods do not qualify as prior art.

A conventional munition includes a container housing, a high explosive, and optionally, fragments. Upon detonation of the high explosive, the container is torn apart forming fragments that are accelerated outwardly. In addition, to the extent that fragments are located within the container, these internal fragments are also propelled outwardly. The "kill mechanism" of the conventional fragmentation warhead is the penetration of the fragments (usually steel) into the device or target, which is kinetic energy dependent.

Reactive fragments are used to enhance the lethality of such munitions. A reactive fragment enhances the lethality of the device by transferring additional energy into the target. Upon impact with the target reactive fragments release additional chemical or thermal energy thereby enhancing damage, and potentially improving the lethality of the munition. The reactive fragment employs both kinetic energy transfer of the accelerated fragment into the target as well as the release chemical energy stored by the fragment. Moreover, the released chemical energy can be transferred to the surroundings thermally through radiant, conductive, and/or convective heat transfer. Thus, unlike purely kinetic fragments, the effects of such reactive fragments extend beyond the trajectory thereof.

Some reactive fragments employ composite materials based on a mixture of reactive metal powders and an oxidizer suspended in an organic matrix. However, certain engineering challenges are often encountered in the development of such reactive fragments. For example, a minimum requisite amount of activation energy must be transferred to the reactive fragments in order to trigger the release of chemical energy. There has been a general lack of confidence in the ignition of such reactive fragments upon impact at velocities less than about 4000 ft/s. The reactive fragments must possess a certain amount of structural integrity in order to survive shocks encountered upon launch of the munition, but must also begin to combust upon impact with a target. Thus, such conventionally constructed reactive fragments present an engineering challenge; they favor a low launch velocity to enhance survival of the fragment upon launch, yet also benefit from higher launch velocities which are desirable for energetic initiation.

Thus, it would be advantageous to provide an improved reactive fragment which may address one or more of the above-mentioned concerns.

Relevant publications include U.S. Pat. Publication Nos. 3,961,576; 4,996,922; 5,538,795; 5,700,974; 5,912,069; 5,936,184; 6,627,013; 6,679,960; 6,736,942; 6,863,992; 2001/0046597; 2002/0069944; 2003/0164289; and 2005/0142495, the entire disclosure of each of these publications is incorporated herein by reference.

SUMMARY OF THE INVENTION

According to the present invention, there is provided a munition including, but not limited to, a reactive fragment which possesses improved and tailorable energy reactive behavior that can, for example, reduce the impact velocity necessary to initiate an energetic reaction.

According to one aspect, the present invention includes, but is not limited to, a munition comprising a reactive fragment comprising a energetic material dispersed in a binder material, the energetic material comprises a thin layered structure, the thin layered structure comprises at least one layer comprising a reducing metal or metal hydride and at least one layer comprising a metal oxide.

According to another aspect, the present invention includes, but is not limited to, a method comprising forming a energetic material comprising a thin film or thin layered structure, the structure comprises at least one layer comprising a reducing metal and at least one layer comprising a metal oxide; combining the energetic material with a binder material to form a mixture; and shaping the mixture to form a reactive fragment.

BRIEF DESCRIPTION OF THE DRAWING FIGURES

The following detailed description of preferred embodiments can be read in connection with the accompanying drawings in which like numerals designate like elements and in which.

DETAILED DESCRIPTION

Figure 1:
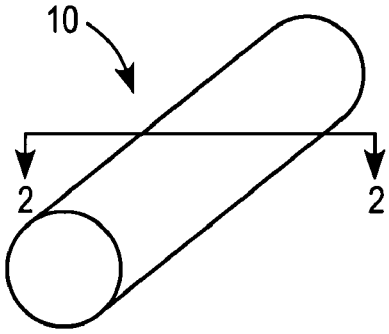
FIG. 1 is a perspective view of a reactive fragment formed according to the principles of the present invention.

One embodiment of a reactive fragment 10 formed according to the principles of the present invention is illustrated in FIG. 1. According to the illustrated embodiment, the fragment 10 has a generally cylindrical geometry. However, it should be understood that any suitable geometry is comprehended by the scope of the present invention. Thus, the fragment 10 could also be formed with a spherical, polygonal, or other suitable geometry which renders it effective for its intended purpose.

Figure 2:
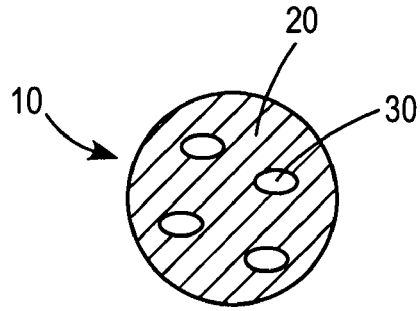
FIG. 2 is a cross-section of the reactive fragment of FIG. 1 taken along line 2-2.

As illustrated in FIG. 2, the reactive fragment 10 generally comprises a binder material 20 having a reactive energetic material 30 dispersed therein.

The binder material 20 can be formed from any suitable material. According to one embodiment, the binder material 20 comprises a polymeric material, including, but not limited to any epoxy or a polymer containing at least one azide group. According to a further optional embodiment, the binder may comprise a thermoplastic material such as polyethylene, polypropylene, polyetherimide, polyethylene teraphthalate, and acrylonitrile butadiene styrene In addition, the binder material 20 may optionally include one or more reinforcing elements or additives. Thus, the binder material 20 may optionally include one or more of: an organic material, an inorganic material, a metastable intermolecular compound, and/or a hydride. For example, the binder may be reinforced using organic or inorganic forms of continuous fibers, chopped fibers, a woven fibrous material, filaments, whiskers, or dispersed particulate.

Fragment 10 may contain any suitable reactive energetic material 30, which is dispersed within the binder material 20. The volumetric proportion of binder with respect to reactive materials may be in the range of about 20 to about 80%, with the reminder of the fragment being comprised of reactive energetic materials. The energetic material 30 may have any suitable morphology (i.e., powder, flake, crystal, etc.) or composition.

The energetic material 30 may comprise a material, or combination of materials, which upon reaction, release enthalpic or work-producing energy. One example of such a reaction is called a "thermite" reaction. Such reactions can be generally characterized as a reaction between a metal oxide and a reducing metal which upon reaction produces a metal, a different oxide, and heat. There are numerous possible metal oxide and reducing metals which can be utilized to form such reaction products. Suitable combinations include but are not limited to, mixtures of aluminum and copper oxide, aluminum and tungsten oxide, magnesium hydride and copper oxide, magnesium hydride and tungsten oxide, tantalum and copper oxide, titanium hydride and copper oxide, and thin films of aluminum and copper oxide. A generalized formula for the stoichiometry of this reaction can be represented as follows:

$$M_xO_y+M_z=M_x+M_zO_y+\text{Energy}$$

wherein $M_xO_y$ is any of several possible metal oxides, $M_z$ is any of several possible reducing metals, $M_x$ is the metal liberated from the original metal oxide, and $M_zO_y$ is a new metal oxide formed by the reaction. Thus, according to the principles of the present invention, the energetic material 30 may comprise any suitable combination of metal oxide and reducing metal which as described above produces a suitable quantity of energy spontaneously upon reaction. For purposes of illustration, suitable metal oxides include: $La_2O_3$, AgO, $ThO_2$, SrO, $ZrO_2$, $UO_2$, BaO, $CeO_2$, $B_2O_3$, $SiO_2$, $V_2O_5$, $Ta_2O_5$, NiO, $Ni_2O_3$, $Cr_2O_3$, $MoO_3$, $P_2O_5$, $SnO_2$, $WO_2$, $WO_3$, $Fe_3O_4$, $MoO_3$, NiO, CoO, $Co_3O_4$, $Sb_2O_3$, PbO, $Fe_2O_3$, $Bi_2O_3$, $MnO_2$, $Cu_2O$, and CuO. For purposes of illustration, suitable reducing metals include: Al, Zr, Th, Ca, Mg, U, B, Ce, Be, Ti, Ta, Hf, and La. The reducing metal may also be in the form of an alloy or intermetallic compound of the above. For purposes of illustration, the metal oxide is an oxide of a transition metal. According to another example, the metal oxide is a copper or tungsten oxide. According to another alternative example, the reducing metal comprises aluminum or an aluminum-containing compound. By way of non-limiting example, suitable metal oxide/reducing metal pairs include: $Al/MoO_3$; $Al/Bi_2O_3$; AlCuO; and $Al/Fe_2O_3$.

As noted above, the energetic material components 30 may have any suitable morphology. Thus, the energetic material 30 may comprise a mixture of fine powders of one or more of the above-mentioned metal oxides and one or more of the reducing metals. This mixture of powders may be dispersed in the binder 20.

Figure 3:
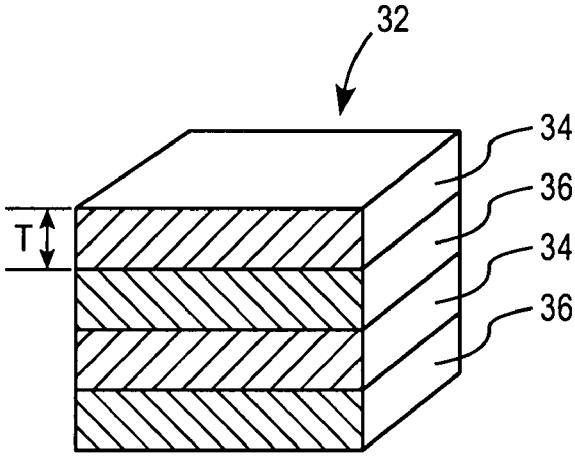
FIG. 3 is a schematic cross-section of a thin-film reactive material formed according to the principles of the present invention.

Alternatively, as schematically illustrated in FIG. 3, the energetic material 30 may be in the form of a thin film 32 having at least one layer of any of the aforementioned reducing metals 34 and at least one layer of the aforementioned metal oxides 36. The thickness T of the alternating layers can vary, and can be selected to impart desirable properties to the energetic material 30. For purposes of illustration, the thickness T of layers 34 and 36 can be about 10 to about 1000 nm. The layers 34 and 36 may be formed by any suitable technique, such as chemical or physical deposition, vacuum deposition, sputtering (e.g., magnetron sputtering), or any other suitable thin film deposition technique. Each layer of reducing metal 34 present in the thin-film can be formed from the same metal. Alternatively, the various layers of reducing metal 34 can be composed of different metals, thereby producing a multilayer structure having a plurality of different reducing metals contained therein. Similarly, each layer of metal oxide 36 can be formed from the same metal oxide. Alternatively, the various layers of metal oxide 36 can be composed of different oxides, thereby producing a multilayer structure having different metal oxides contained therein. The ability to vary the composition of the reducing metals and/or metal oxides contained in the thin-film structure advantageously increases the ability to tailor the properties of the energetic material 30, and thus the properties of the reactive fragment 10.

The reactive fragment 10 of the present invention can be formed according to any suitable method or technique.

Generally speaking, a suitable method for forming a reactive fragment includes forming an energetic material, combining the energetic material with a binder material to form a mixture, and shaping the combined energetic material and binder material mixture to form a reactive fragment.

The energetic material can be formed according to any suitable method or technique. For example, when the energetic material is in the form of a thin film, as mentioned above, the thin-film energetic material can be formed as follows. The alternating layers of oxide and reducing metal are deposited on a substrate using a suitable technique, such as vacuum vapor deposition or magnetron sputtering. Other techniques include mechanical rolling and ball milling to produce layered structures that are structurally similar to those produce in vacuum deposition. The deposition or fabrication processes are controlled to provide the desired layer thickness, typically on the order of about 10 to about 1000 nm. The thin-film comprising the above-mentioned alternating layers is then removed from the substrate. Removal can be accomplished by a number of suitable techniques such as photoresist coated substrate lift-off, preferential dissolution of coated substrates, and thermal shock of coating and substrate to cause film delamination. According to one embodiment, the inherent strain at the interface between the substrate and the deposited thin film is such that the thin-film will flake off the substrate with minimal or no intervention.

The removed layered material is then reduced in size; preferably, in a manner such that the pieces of thin-film having a reduced size are also substantially uniform. A number of suitable techniques can be utilized to accomplish this. For example, the pieces of thin-film removed from a substrate can be worked to pass them through a screen having a desired mesh size. By way of non-limiting example, the mesh size can be 25-60 mesh. This accomplishes both objectives of reducing the size of the pieces of thin-film removed from the substrate, and rendering the size of these pieces substantially uniform.

The above-mentioned reduced-size pieces of layered film are then combined with matrix material to form a mixture. The binder material can be selected from many of the above-mentioned binder materials. This combination can be accomplished by any suitable technique, such as mixing or blending. Optionally, the pieces of thin-film and/or the binder material can be treated in a manner that functionalizes the surface(s) thereof, thereby promoting wetting of the pieces of thin-film in the matrix of binder. Such treatments are per se known in the art. For example, the particles can be coated with a material that imparts a favorable surface energy thereto. Additives or additional components can be added to the mixture. As noted above, such additives or additional components may comprise one or more of: an organic material, an inorganic material, a metastable intermolecular compound, a hydride, and/or a reinforcing agent. Suitable reinforcing agents include fibers, filaments, and dispersed particulates.

This mixture can then be shaped thereby forming a reactive fragment having a desired geometrical configuration. The fragment can be shaped by any suitable technique, such as casting, pressing, forging, cold isostatic pressing, hot isostatic pressing, etc. The pressure necessary to form the fragment being less than a pressure necessary to ignite the energetic material 30. As noted above, the reactive fragment can be provided with any suitable geometry, such as cylindrical, spherical, polygonal, or variations thereof.

Figure 4:
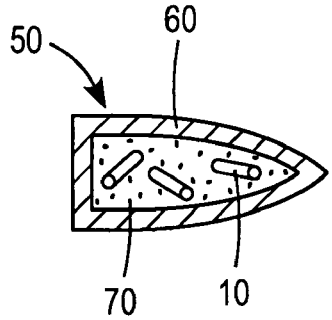
FIG. 4 is a schematic cross-section of a warhead formed according to the principles of the present invention.

There are number of potential applications for a reactive fragment formed according to principles of the present invention. As depicted in FIG. 4, one illustrative, non-limiting, application is the inclusion of reactive fragment 10 within a warhead 50. The warhead 50 generally comprises a penetrator casing 60 which houses a conventional explosive charge 70 and one or more reactive fragments 10. According to the illustrated example, a plurality of reactive fragments 10 are included. Non-limiting exemplary penetrator configurations that may benefit from inclusion of reactive fragments formed according to the present invention include a BLU-109 warhead or other munition such as BLU-109/B, BLU-113, BLU-116, and J-1000.

Although in the illustrated example, the reactive fragments 10 in the explosive charge 70 are randomly combined within the warhead 50, it should be recognized at the reactive fragments 10 and the explosive charge 70 can be arranged in different ways. For example, reactive fragments and an explosive charge may be separated or segregated, and may have spacers or buffers placed between them. Such an arrangement may be advantageous when it is desired to lessen the sensitivity of the reactive fragments. That is, upon impact of the warhead 50 with an appropriate target, the energy imparted to the reactive fragments is delayed via the above noted physical separation and/or spacers or buffers. Thus, the chemical energy released upon activation of the reactive fragments can also be delayed, which may be desirable to maximize the destructive effects of the warhead upon a particular target or groups of targets.

Figure 5:
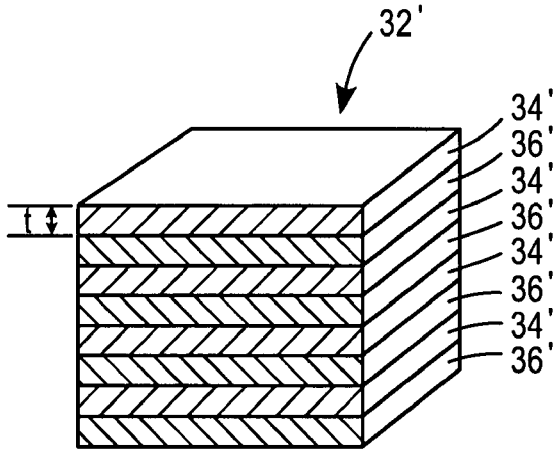
FIG. 5 is a schematic cross-section of a thin-film reactive material formed according to an alternative embodiment of the present invention.

One advantage of a reactive fragment formed according to principles of the present invention is that both the composition and/or morphology of the reactive material 30 can be used to tailor the sensitivity of the reactive fragment to impact forces. While the total chemical energy content of the reactive material is primarily a function of the quantity of the reducing metal and metal oxide constituents, the rate at which that energy is released is a function of the arrangement of the reducing metal and metal oxide relative to one another. For instance, the greater the degree of mixing between the reducing metal and metal oxide components of the energetic material, the quicker the reaction that releases thermal energy will proceed. Consider the embodiment of the thin-film 32' depicted in FIG. 5 compared with the embodiment of the thin-film 32 depicted in FIG. 3. The layers of reducing metal 34' and metal oxide 36' contained in the thin-film 32' have a thickness t which is less than that of the thickness T of the layers in thin-film 32 (T>t). Otherwise, the volume of the thin films 32 and 32' are the same. Thus, the total mass of reducing metal and the total mass of metal oxide contained in the two thin films are likewise the same. As a result, the total thermal energy released by the two films should be approximately the same. However, it is evident that the reducing metal and metal oxide are intermixed to a greater degree in the thin-film 32'. The thermal energy released by the thin-film 32' will proceed at a faster rate than the release of thermal energy from the thin-film 32. Thus, the timing of the release of thermal energy from a thin-film formed according to the principles of the present invention can be controlled to a certain extent by altering the thickness of the layers of reducing metal and metal oxide contained therein.

Similarly, the timing of the release of chemical energy from a thin-film formed according to the principles of the present invention can also be controlled, at least to some degree, by the selection of materials, and their location, within a thin-film. For example, in the thin-film 32' depicted in FIG. 5, the rate at which thermal energy is released can be altered by placing layers of metal oxide and/or reducing metal which have a greater reactivity toward the interior of the thin film 32', while positioning reducing metal and/or metal oxide layers having a lower reactivity on the periphery (i.e. top and bottom). Since those layers located on the periphery of the thin-film 32' are presumably more susceptible to ignition due to their proximity to outside forces, these layers will begin to release thermal energy prior to those layers contained on the interior. By placing less reactive materials on the periphery, the overall reaction rate of the thin-film 32 can be slowed.

Figure 6:
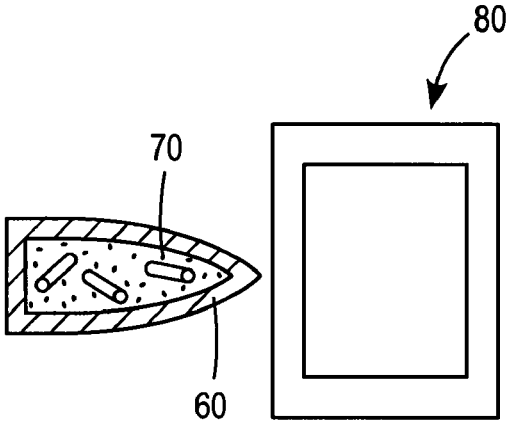
FIG. 6 is a schematic illustration of a mode of operation of an embodiment of the present invention, at a first stage.
Figure 7:
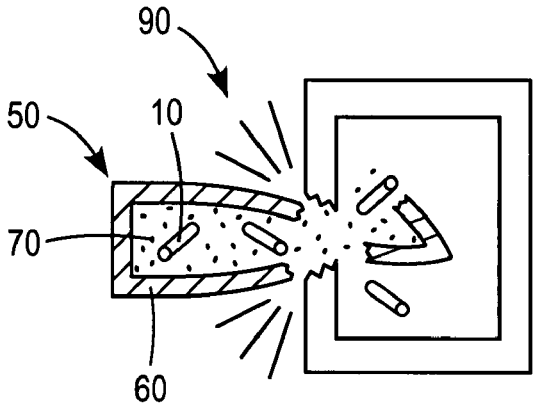
FIG. 7 is a schematic illustration of a mode of operation of an embodiment of the present invention, at a second stage.
Figure 8:
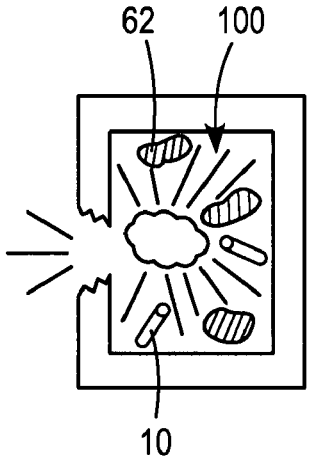
FIG. 8 is a schematic illustration of a mode of operation of an embodiment of the present invention, at a third stage.

The ability to tailor the rate of release of thermal energy from a reactive fragment can be advantageous in the design of certain munitions. For example, in the case of a penetrating warhead containing reactive fragments, it can be desirable to maximize the release of energy from the warhead after the target has been penetrated, thereby maximizing the destructive effects of the warhead. This behavior is schematically illustrated in FIGS. 6-8 as illustrated in FIG. 6, a warhead 50 containing reactive fragments 10 and an explosive charge 70 approaches a target 80. Upon collision (FIG. 7), the warhead 50 begins to penetrate the target 80 and an initial release of kinetic and thermal energy 90 occurs, primarily due to the kinetic impact of the warhead casing 60 and the initial release of thermal energy, mainly from the explosive charge 70. At this stage, the kinetic and thermal effects of the fragments on the target 90 are minimal. At a later stage, depicted in FIG. 8, the target has been fully penetrated and a subsequent release of kinetic and thermal energy is imparted to the target 80. As illustrated in FIG. 8, the casing 60 has broken apart releasing casing fragments 62 which kinetically impact the target 90. The fragments 10 also kinetically impact the target. At this point, a subsequent release of thermal energy also occurs, which is a combination of thermal energy released from the explosive charge 70, as well as the release of thermal energy from the energetic material 30 contained in the reactive fragments 10, which has been intentionally delayed so as to occur within the interior region of the target, thereby maximizing the destructive capabilities of the warhead 50.

One alternative munition in which the reactive fragments (10) of the present invention may be utilized (not shown) comprises a warhead designed to detonate prior to impacting the target, the reactive fragments (10) are propelled into the target and can then release the chemical energy stored therein.

Another advantage provided by the present invention is the ability to design reactive fragments which can react at lower impact velocities, for example, at impact velocities on the order of 2,000 ft/sec. or less. This is an improvement over the existing technology because: (1) it permits reduced launch velocity thereby improving the survivability of the fragment; (2) extends the reactive envelope of the fragment by allowing the fragment to travel further before it lacks the kinetic energy to ignite; and (3) opens the system design space by potentially reducing the size of the warhead.

All numbers expressing quantities of ingredients, constituents, reaction conditions, and so forth used in the specification are to be understood as being modified in all instances by the term "about". Notwithstanding that the numerical ranges and parameters setting forth, the broad scope of the subject matter presented herein are approximations, the numerical values set forth are indicated as precisely as possible. Any numerical value, however, inherently contains certain errors necessarily resulting from the standard deviation found in their respective measurement techniques.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A munition comprising:

a reactive fragment comprising an energetic material dispersed in a binder material, the energetic material comprises a thin layered structure, and the thin layered structure comprises at least one layer comprising a reducing metal or metal hydride and at least one layer comprising a metal oxide, wherein the thin layered structure is in a form of at least one particle having a size such that the particle will pass through a 25-60 size mesh screen.

2. The munition of claim 1, wherein the reactive fragment is shaped as a cylinder or a polygon.

3. The munition of claim 1, wherein the energetic material is flaked, powdered, or crystallized.

4. The munition of claim 1, wherein the layers have a thickness of about 10 to about 10000 nm.

5. The munition of claim 1, wherein the reactive fragment additionally comprises one or more of: an organic material, and inorganic material, a metastable intermolecular composite, or a hydride.

6. The munition of claim 1, wherein at least one of the energetic materials and the binder material is surface treated to promote wetting.

7. The munition of claim 1, further comprising a reinforcing agent comprising one or more of fibers, filaments, dispersed particulates, and mixtures thereof.

8. The munition of claim 1, wherein the binder comprises a polymer.

9. The munition of claim 8, wherein the binder comprises: an epoxy; a polymer containing at least one azide group.

10. The munition of claim 9, wherein the binder comprises at least one of: polyethylene, polypropylene, polyetherimide, polyethylene teraphthalate, and acrylonitrile butadiene styrene.

11. The munition of claim 1, wherein the munition comprises a warhead, the warhead comprising a casing, and wherein the reactive fragment is disposed within the casing.

12. The munition of claim 11, further comprising a high explosive contained within the casing.

13. A method comprising:

forming an energetic material comprising a thin film or thin layered structure, the structure comprises at least one layer comprising a reducing metal and at least one layer comprising a metal oxide;

combining the energetic material with a binder material to form a mixture; and shaping the mixture to form a reactive fragment, wherein the thin film or thin layered structure is in a form of at least one particle having a size such that the particle will pass through a 25-60 size mesh screen.

14. The method of claim 13, wherein shaping the mixture comprises imparting a cylindrical or polygonal or other shape to the fragment.

15. The method of claim 13, wherein forming an energetic material comprises:

forming layers of a reducing metal and a metal oxide material by a vacuum deposition or mechanical mixing process;

and reducing a size of the pieces of thin film to form particles.

16. The method of claim 13, wherein the layers have a thickness of about 10 to about 10000 nm.

17. The method of claim 13, wherein the metal oxide material is an oxide of a transition metal element; and wherein the reducing metal is aluminum or aluminum-based.

18. The method of claim 13, further comprising adding one or more of the following to the mixture: an organic material, and inorganic material, a metastable intermolecular composite, or a hydride.

19. The method of claim 13, further comprising treating the surface of at least one of the energetic materials and the binder material in order to promote wetting.

20. The method of claim 13, further comprising adding one or more of fibers, filaments, dispersed particulates, and mixtures thereof to the binder.

21. The method of claim 13, wherein the binder comprises a polymer.

22. The method of claim 21, wherein the binder comprises: an epoxy; a polymer containing at least one azide group.

23. The method of claim 22, wherein the binder comprises at least one of: polyethylene, polypropylene, polyetherimide, polyethylene teraphthalate, and acrylonitrile butadiene styrene.

24. The method of claim 13, further comprising placing the reactive fragment within a casing of a warhead.

25. The method of claim 24, further comprising adding a high explosive with the mixture within the casing.

26. A munition comprising:

a casing;

a plurality of shaped reactive fragments comprising an energetic material dispersed in a binder material, the energetic material comprises a thin layered structure, and the thin layered structure comprises at least one layer comprising a reducing metal or metal hydride and at least one layer comprising a metal oxide; and a high explosive, wherein the reactive fragments and the high explosive are disposed within the casing and wherein the reactive fragments are dispersed throughout the high explosive and wherein the thin layered structure is in a form of at least one particle having a size such that the particle will pass through a 25-60 size mesh screen.

* * * * *